US008667650B1

(12) United States Patent
Duffin

(10) Patent No.: US 8,667,650 B1
(45) Date of Patent: Mar. 11, 2014

(54) DECORATIVE MAGNETIC CUFFLINK CONVERSION DEVICE

(76) Inventor: Marcus L Duffin, Beaverton, OR (US)

( * ) Notice: Subject to any disclaimer, the term of this patent is extended or adjusted under 35 U.S.C. 154(b) by 36 days.

(21) Appl. No.: 13/453,302

(22) Filed: Apr. 23, 2012

(51) Int. Cl.
*A44B 5/00* (2006.01)

(52) U.S. Cl.
USPC ..... 24/102 SL; 24/102 FC; 24/113 MP; 24/114.11; 24/303

(58) Field of Classification Search
None
See application file for complete search history.

(56) References Cited

U.S. PATENT DOCUMENTS

| | | | | |
|---|---|---|---|---|
| 2,483,031 | A | 9/1949 | Avedon | |
| 3,535,747 | A | 10/1970 | Benn | |
| 4,528,726 | A * | 7/1985 | Kurashima | 24/102 SL |
| 5,974,634 | A | 11/1999 | Eisenpresser | |
| 7,992,264 | B2 | 8/2011 | Abadi | |
| 2003/0154576 | A1 | 8/2003 | Mirharooni | |
| 2006/0236509 | A1 * | 10/2006 | Ausman | 24/303 |

* cited by examiner

*Primary Examiner* — Jack W. Lavinder
(74) *Attorney, Agent, or Firm* — Harpman & Harpman

(57) ABSTRACT

An adaptable magnetic cufflink assembly to convert conventional button sleeve button cuffs to a decorative French cuff cufflink. A cuff button attachment clip is magnetically secured through a shirt sleeve cuff portion to a magnet retainment stud having a selective fastener assembly registerable with a decorative cufflink overlay.

5 Claims, 2 Drawing Sheets

DECORATIVE MAGNETIC CUFFLINK CONVERSION DEVICE

BACKGROUND OF THE INVENTION

1. Technical Field

This invention relates generally to magnetic fasteners and the like, but more specifically to cufflinks that are used to retain a shirt sleeve's cuff together at its terminus. Such cuff retainment devices are typically of a button cuff configuration or a true decorative cufflink that is inserted through a pair of button holes in the sleeve to secure the cuff together, known as a French cuff.

2. Description of Prior Art

Prior art devices of this nature have been directed to a variety of cuff closure devices; see for example U.S. Pat. Nos. 2,483,031, 3,535,747, 5,974,634, 7,992,264 and U.S. Publications 2003/0154576 and 2006/0236509.

U.S. Pat. No. 2,483,031 is directed to a magnetic cufflink having a two-part construction. A first half has armatures connected by a linkage. A magnetic second half connected by a linkage as is magnetically attached to the first half.

U.S. Pat. No. 3,535,747 claims an interchangeable cufflink configuration having a stem portion and a detachable decorative top portion.

U.S. Pat. No. 5,974,634 illustrates a decorative multiple use magnetic button configuration in which a shell encapsulates a first magnet and a second magnet is provided on the opposite side of the cloth layer of a garment thereby attracting same to the shell through the fabric and securing it thereto.

U.S. Pat. No. 7,992,264 shows a magnetic closure with a clasp having a first outer magnet and a second inner magnet attached to a chain and button hole engagement T configuration. A second embodiment illustrates a false cufflink with a first magnet in a decorative housing and a second magnet placed over the button hole. Accordingly, the two magnets sandwich the button therebetween securing the cuff together.

In U.S. Patent Publication 2003/0154576 a two-piece magnetic button that secures the cuff together is disclosed.

U.S. Patent Publication 2006/0236509 illustrates a magnetically encapsulating clothing fastener with interchangeable male and female fittings.

SUMMARY OF THE INVENTION

The present invention is directed to converting button styled shirt sleeve cuffs into emulating independent detachable cufflinks used on French cuff type shirts. The cuff button enclosure of the invention is engaged over and around a cuff button providing a magnetic attachment for the decorative cufflink configuration. A magnet button hole decorative stud portion is passed through the existing cuff button hole and then magnetically attaches to the cuff button enclosure through the cuff material fastening the shirt cuffs together as a traditional cufflink would do displaying an outwardly facing decorative cufflink portion.

DETAILED DESCRIPTION OF THE INVENTION

Figure 1:
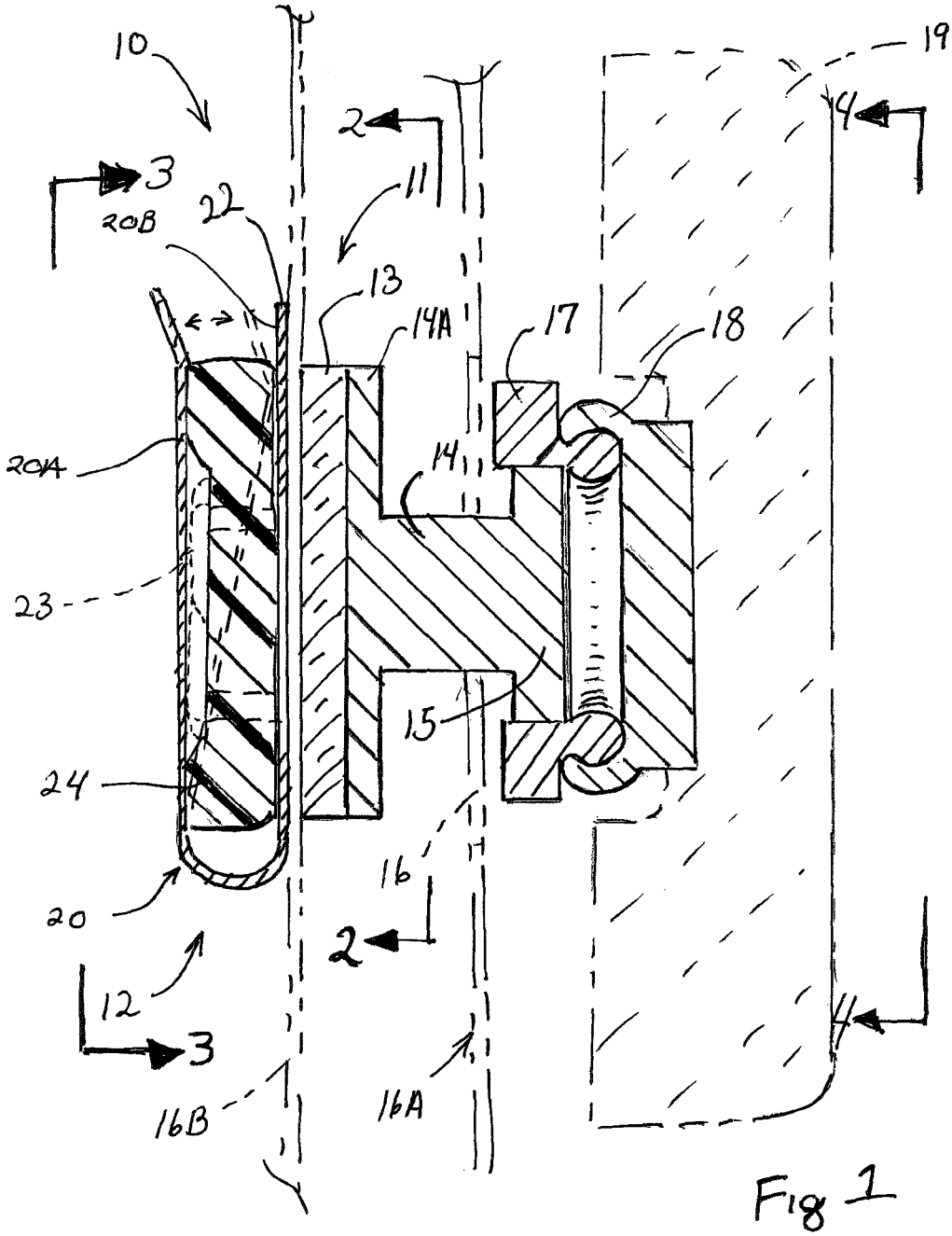
FIG. 1 is an enlarged cross-sectional view of the magnetic cufflink of the invention positioned on a portion of a button cuff sleeve.
Figure 2:
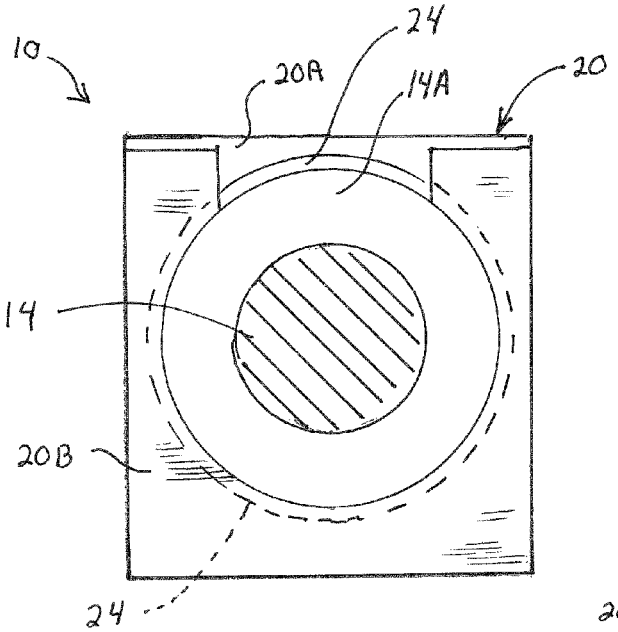
FIG. 2 is an enlarged sectional view on lines 2-2 of FIG. 1.
Figure 3:
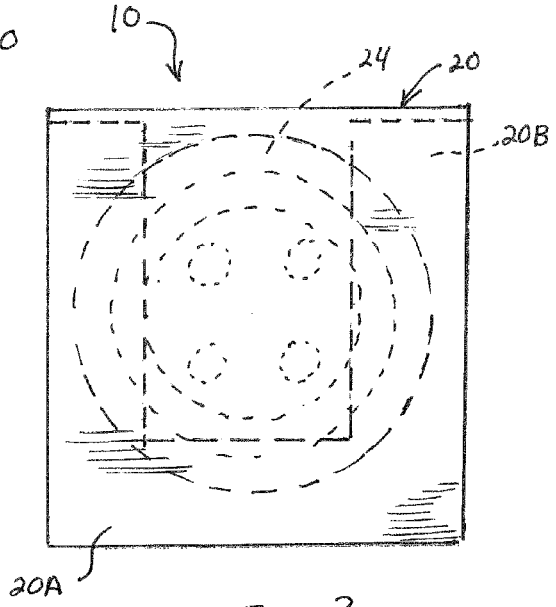
FIG. 3 is an enlarged sectional view on lines 3-3 of FIG. 1.
Figure 4:
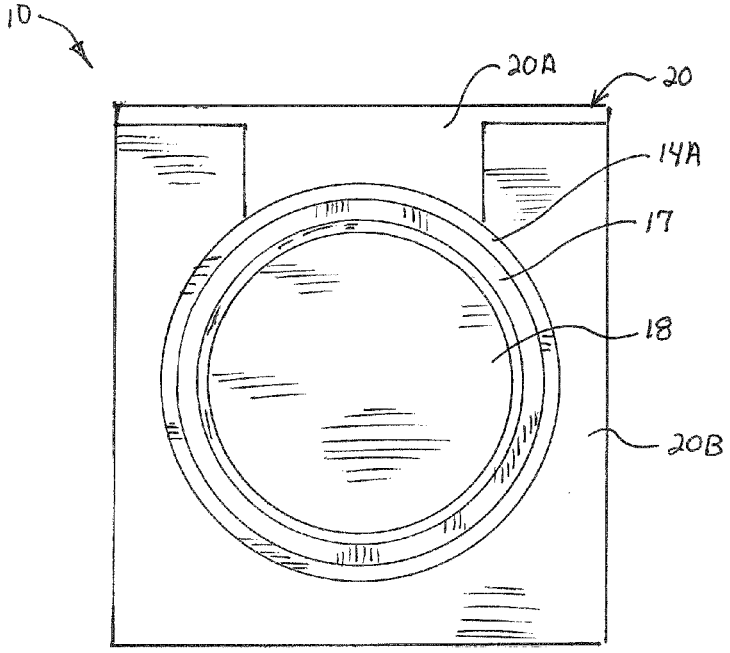
FIG. 4 is an enlarged end view on lines 4-4 of FIG. 1.

Referring to FIGS. 1, 2 and 3 of the drawings, a magnetic cufflink button assembly 10 of the invention can be seen having a cuff attachment stud and display 11 and a button cuff engagement fitting 12. The stud display 11 has an annular magnetic plate 13 with an upstanding lug portion 14 centrally positioned therefrom. The lug portion 14 has a retainment mount 15 thereon of a diameter greater than that of the lug portion 14 and less than that of the magnetic plate 13. The magnetic plate 13 is secured to a lug base 14A and is preferably of a monolithic strong magnetic material such as a neodymium magnet which has a high magnetism to mass weight ratio assuring applicable performance use criteria configurations as will be described in detail hereinafter.

As seen in FIG. 1 of the drawings, the attachment stud display 11 is of a dimensional configuration that will allow the magnetic plate 13 to selectively pass through a button hole opening at 16 in a shirt sleeve cuff portion so 16A and be retained therein. The retainment mount 15 has a mail snap fastener fitting 17 thereon for selective registration with a female snap fastener fitting 18 on an ornamental cufflink fixture 19 shown in broken lines in FIG. 1 of the drawings which is interchangeable therewith.

The button cuff engagement fitting 12 has a spring clip body configuration 20 with oppositely disposed upper surface 20A and a lower surface 20B.

A mounting access slot at 21 is formed in the lower surface 20B and extends inwardly from a clip edge 22. The clip body 20 is of a one-piece construction and therefore imparts a resilient action between the corresponding upper and lower surfaces 20A and 20B. The so defined mounting access slot at 21 is of a dimension to accommodate attachment threads 23 of a cuff button 24 on a shirt sleeve opposing cuff portion 16B as best seen, as noted, in FIG. 1 of the drawings.

The cuff button 24 is retained within the clip 20 by the clips resilient nature as will be understood by those skilled in the art.

The interchangeable ornamental cufflink fixture 19 is so formed to simulate a traditional independent one-piece cufflink (not shown) that is used in so-called "French cuff" shirts that are without cuff buttons.

In use, once the magnetic attachment stud display 11 is inserted into the existing cuff button hole opening at 16 and the button cuff engagement fitting 12 is "clipped" onto the existing cuff button 24 and retained as hereinbefore described, the respective thus engaged shirt sleeve cuff portions 16A and 16B can be brought together "magnetically" as seen in FIG. 1 of the drawings. Accordingly, the strong magnetic based magnetic plate 13 will attract and secure through the cuff material portion 16B to the correspondingly aligned ferrous metal low surface 20B of the button cuff clip body 20 positioned, as noted, on the cuff button 24 retaining same together in a traditional appearing manner of a formal cuff link (not shown).

It will be seen therefore that the magnetic cufflink button assembly 10 of the invention will emulate the traditional independent cufflink (not shown) used on so-call French cuff shirts.

It will be noted that there hereinbefore disclosed and described magnetic cufflink button assembly 10 may have alternate dimensional forms and that the described resilient clip body 20 can be of any alternate configuration adapted to frictionally engage around the button 24 and retain the button cuff engagement fitting 12 of the magnetic cufflink button assembly 10 thereon and is therefore not limited to the so described examples thereof. Additionally, the male and female snap fasteners 17 and 18 may be of any so configured interengaging fastener configuration and therefore not limited to the hereinbefore described examples chosen for illustration.

Having thus described my invention, it will be evident to those skilled in the art that various changes and modifications may be made therein without departing from the spirit of the invention.

Therefore I claim:

1. A magnetic cufflink assembly for a shirt sleeve cuff having a cuff engagement portion and a cuff button engagement portion, said cuff engagement portion comprises, a magnetic retainment stud having a magnetic plate, an insertion lug extending from said plate, a first fastener element on said insertion lug in oppositely disposed spaced relation to said magnetic plate, a second fastener element on a decorative ornamental element selectively interengageable with said first fastener element, said cuff button engagement portion comprises, a resilient clip registerable over and retained exclusively on a cuff button and a button thread access opening in said clip, said retainment resilient clip spaced inwardly of sleeve cuff edges and magnetically secured to said magnetic plate through said sleeve cuff when so engaged on a sleeve cuff button.

2. The magnetic cufflink assembly set forth in claim 1 wherein said magnetic plate is of a neodymium magnet.

3. A magnetic cufflink assembly for a button shirt sleeve cuff having a first cuff engagement portion and a cuff button engagement portion, said first cuff engagement portion comprises, a magnetic retainment stud, a fastener assembly secured thereon, a decorative ornamental element selectively secured by said fastener assembly thereto in oppositely disposed relation to said magnetic retainment stud, said cuff button engagement portion comprises, a resilient clip and a button thread access opening said clip registerable over and retained independently by a cuff button on said shirt sleeve cuff.

4. The magnetic cufflink assembly set forth in claim 3 wherein said magnetic retainment stud comprises, a magnetic plate, a button hole insertion lug extending from said plate, a first fastener element of said fastener assembly on said insertion lug in oppositely disposed relation to said magnetic plate, said resilient clip magnetically secured to said magnetic plate through a portion of the sleeve cuff when so engaged on the cuff bottom.

5. The magnetic cufflink assembly set forth in claim 4 wherein said magnetic plate is of a neodymium magnet.

* * * * *